United States Patent [19]

Kimata et al.

[11] 4,164,923

[45] Aug. 21, 1979

[54] FUEL INJECTION DEVICE FOR INTERNAL COMBUSTION ENGINES

[75] Inventors: Kei Kimata, Ama; Tsugito Nakazeki; Saburo Oshima, both of Iwata, all of Japan

[73] Assignee: NTN Toyo Bearing Co. Ltd., Osaka, Japan

[21] Appl. No.: 710,128

[22] Filed: Jul. 30, 1976

[30] Foreign Application Priority Data

Jul. 31, 1975 [JP] Japan ..... 50/93970
Aug. 5, 1975 [JP] Japan ..... 50/95691

[51] Int. Cl.[2] ..... F02D 1/00; F02D 3/04

[52] U.S. Cl. ..... 123/140 MC; 123/139 AL; 123/139 BC

[58] Field of Search ..... 123/140 MC, 139 AL, 123/139 BC, 139 MB

[56] References Cited

U.S. PATENT DOCUMENTS

| | | | |
|---|---|---|---|
| 2,910,056 | 10/1959 | Sampietro | 123/140 MC |
| 2,969,738 | 1/1961 | Ulbing | 123/139 AL |
| 3,080,818 | 3/1963 | Wirsching | 123/139 MB |
| 3,398,730 | 8/1968 | Maddalozzo | 123/139 AL |
| 3,986,487 | 10/1976 | Yanai | 123/139 AL |
| 3,994,273 | 11/1976 | Stumpp | 123/139 AL |
| 3,996,910 | 12/1976 | Noguchi et al. | 123/139 BC |

*Primary Examiner*—David H. Brown
*Assistant Examiner*—Thomas H. Webb
*Attorney, Agent, or Firm*—Hall & Houghton

[57] ABSTRACT

The present invention relates to fuel injection device characterized by comprising a main body having an axial cylindrical bore, a fuel supply port, a plurality of fuel metering ports, and a plurality of fuel distributing ports communicating with said fuel metering ports; a rotor having an inlet port communicating with said fuel supply port in said main body, a single metering port associated with said metering ports in said main body, and a hole communicating with said two ports; means for driving said rotor for rotation in synchronism with the rotation of an engine; control means for axially sliding said rotor in unique association with the amount of suction air; and fuel supply means for supplying fuel to the fuel supply port in the main body through a pressure regulating valve, the arrangement being such that the length of time for communication between each metering port of the main body and the metering port of the rotor is controlled in connection with the r.p.m. of the engine and the amount of suction air, while the operation (total amount of suction air)/(engine r.p.m.) and the metering and distribution of fuel are performed.

18 Claims, 15 Drawing Figures

Fig 5
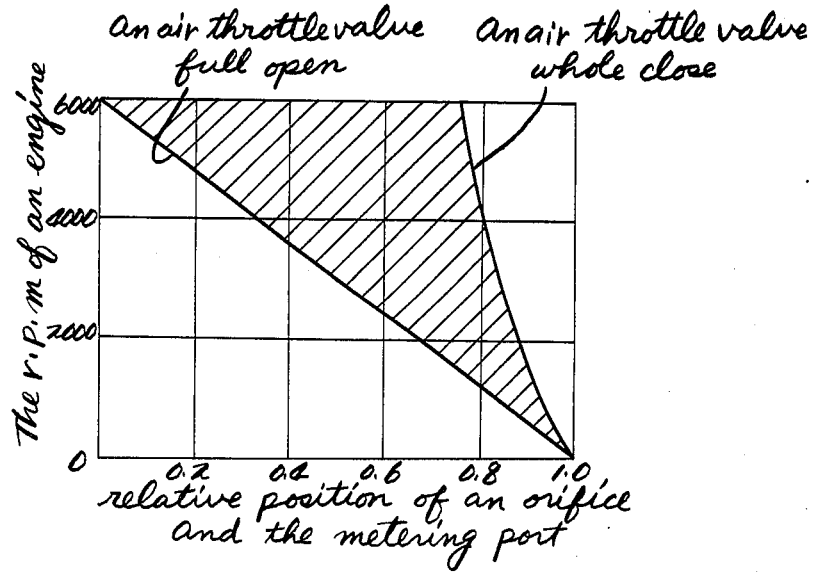
Fig 6
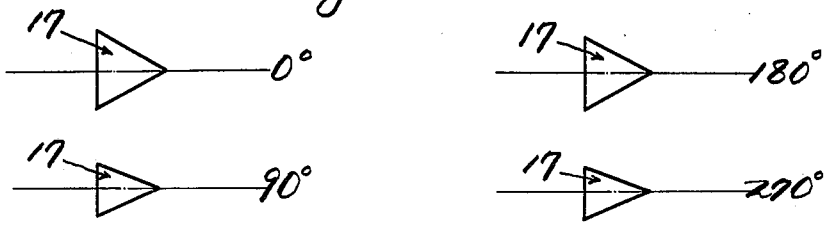
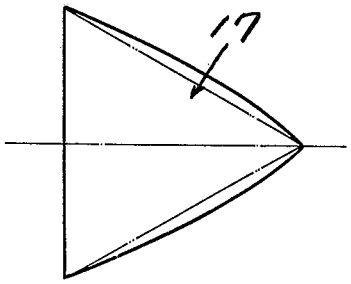
Fig 7a
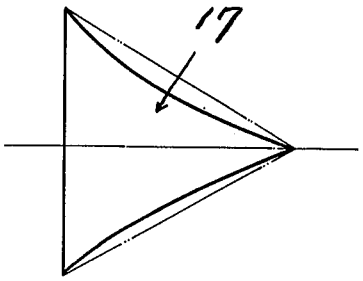
Fig. 7b

A
1
2
3
4
11
12
13
14
15
16
17
18
20
21
22
23
24
25
26
27

45
O
47
P
Q
49
48
50
R
54
46
56
55
57
53
54
52
51

FUEL INJECTION DEVICE FOR INTERNAL COMBUSTION ENGINES

BACKGROUND OF THE INVENTION (a) Field of the Invention

The present invention relates to a fuel injection device for internal combustion engines, and more particularly it relates to a fuel injection device of the suction pipe type or the distribution type in which fuel is intermittently injected.

More specifically, the invention relates to a fuel injection device arranged so that the output from a flow measuring device which directly measures the total amount of fuel to be sucked into an internal combustion engine is uniquely associated with the flow control of the injection device.

(b) Description of the Prior Art

Various fuel injection devices of the distribution type for internal combustion engines have heretofore been developed and put into practical use. FIG. 1 illustrates a distribution type fuel injection device for internal combustion engines which has a close connection with the present invention and whose construction has the following features.

(1) A rotor a is in the form of a cylinder having a pressurized fuel inlet b at one end thereof, the other end being closed, and a triangular window c formed in the outer surface thereof.

(2) A sleeve d is fitted on the rotor a and has as many circumferentially equispaced orifices e as the engine cylinders, said orifices being disposed at positions associated with the triangular window c of the rotor a.

(3) A stator f is provided with window openings g at positions associated with the orifices e in the sleeve d, each window opening g being connected to an injector attached to the suction manifold for the cylinders.

The device shown in FIG. 1 operates as follows.

Fuel pressurized to a fixed value is fed to a cavity h in the rotor a. The rotor a is driven at half the rotational speed of the crank shaft of the engine. Upon rotation of the rotor a, the triangular window c passes the orifices e one after another, so that pressurized fuel is fed to the injectors through the orifices e. If the value opening pressure of the injectors is maintained at a fixed value, the difference in the pressures which exist on both sides of the orifices e is constant, and the amount of fuel passing therethrough is directly proportional to the length of time for which an orifice e is exposed to the triangular window c. In other words, the amount of fuel to be injected at a time is inversely proportional to the r.p.m. of the engine. Further, the sleeve d having orifices e is axially displaced in connection with the amount of air sucked into the engine in such a manner that when the amount of fuel is large, it is moved to the left and when the amount of fuel is small, it is moved to the right. Therefore, it follows that the amount of fuel to be injected at a time increases or decreases in relation to the amount of flow of air. Thus, when the rotor a is rotated at half the speed of the crank shaft of the engine, fuel is injected into individual cylinders once every two revolutions of the crank shaft, the amount of fuel to be injected at a time being proportional to (total amount of fuel)/(r.p.m.) and hence to the amount of air to be used at a time. This device is characterized in that the operation (total amount of suction air)/(r.p.m.) and the fuel distributing and metering function, which are necessary for fuel injection devices of the intermittent injection type controlled by the amount of flow of suction air, are performed by a single mechanism.

The device described above, however, has the following disadvantages: The presence of the two fitting regions between the rotor and the sleeve and between the sleeve and the stator entails the danger of fuel leaking through such regions, causing an increased error of metering. Further, the device has three members which require high machining precision. They are the rotor, sleeve and stator, all of which require a very close tolerance. As a result, much time is required in machining these three members.

SUMMARY OF THE INVENTION

The present invention relates to a fuel injection device characterized by comprising a main body having an axial cylindrical bore, a fuel supply port, a plurality of fuel metering ports, and a plurality of fuel distributing ports communicating with said fuel metering ports; a rotor having an inlet port communicating with said fuel supply port in said main body, a single metering port associated with said metering ports in said main body, and a hole communicating with said two ports; means for driving said rotor for rotation in synchronism with the rotation of an engine; control means for axially sliding said rotor in unique association with the amount of suction air; and fuel supply means for supplying fuel to the fuel supply port in the main body through a pressure regulating valve, the arrangement being such that the length of time for communication between each metering port of the main body and the metering port of the rotor is controlled in connection with the r.p.m. of the engine and the amount of suction air, while the operation (total amount of suction air)/(engine r.p.m.) and the metering and distribution of fuel are performed.

FEATURES OF THE INVENTION

An object of the present invention is to provide a fuel injection device designed so that the operation (total amount of suction air)/(engine r.p.m.) and the metering and distribution of fuel can be accurately performed by a single mechanism.

Another object of the invention is to provide a fuel injection device wherein a fuel metering and distributing mechanism and a flow measuring mechanism for direct measurement of the total amount of suction air are directly coupled together so that the output from the flow measuring mechanism is uniquely associated with the metering control of the fuel metering and distributing mechanism.

BRIEF DESCRIPTION OF THE DRAWINGS

FIG. 5 is a graph showing the relation between the range of axial positions occupied by an orifice during use and the r.p.m. of an engine;

FIG. 6 is a developed view of the opening surface of the metering port;

FIGS. 7*a–b* illustrates variations of the metering port defining a triangular cavity;

DESCRIPTION OF THE PREFERRED EMBODIMENTS

Figure 2:
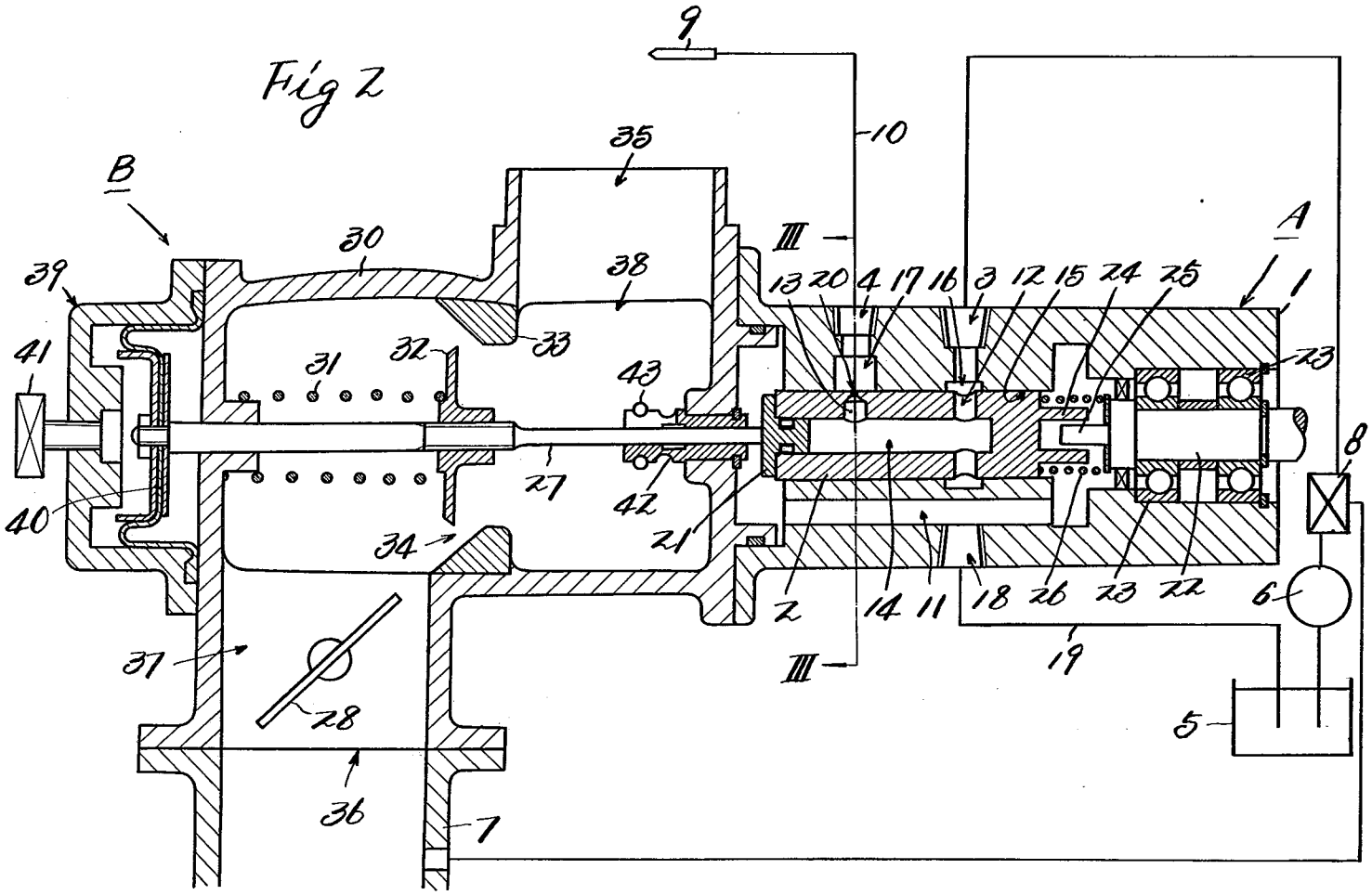
FIG. 2 is a longitudinal section illustrating an embodiment of the invention applied to a 4-cycle 4-cylinder engine.

Referring to FIG. 2 showing a preferred embodiment of the invention, A designates a fuel metering and distributing mechanism and B designates an area flowmeter.

The fuel metering and distributing mechanism A has a cylindrical main body 1 in which a rotor 2 is rotatably and longitudinally slidably received. In this case, the rotor 2 and the main body 1 will be lubricated with gasoline (fuel). In this connection, it is to be noted that if the clearance between the rotor 2 and the main body 1 is greater than 2$\mu$ and smaller than the larger of the two, 7$\mu$ and 1/3,000 of the rotor diameter, then satisfactory performance without any seizure can be achieved. The main body 1 is provided with a fuel supply port 3 and fuel distribution ports 4. The fuel supply port 3 is supplied with fuel from a fuel tank 5 through a pump 6, said fuel being adjusted to a suitable pressure by a pressure regulating valve 8 which suitably adjusts the pressure relative to the negative pressure in a suction pipe 7.

The number of fuel distributing ports 4 is the same as the number of cylinders of an engine to which the invention is applied, and they are equispaced in a plane perpendicular to the axis of the main body 1, each distribution port 4 being connected through a fuel pipe 10 to a fuel injector 9 attached to the suction manifold for the cylinders. The main body 1 is provided with a longitudinally extending communication hole 11 establishing communication between opposite sides of the rotor 2. The rotor 2 is provided with inlet ports 12 and an outlet port 13 at positions associated with the fuel supply port 3 and fuel distributing ports 4 of the main body 1, respectively. The inlet and outlet ports 12 and 13 communicate with each other through a cavity 14 formed in the rotor 2.

Figure 1:
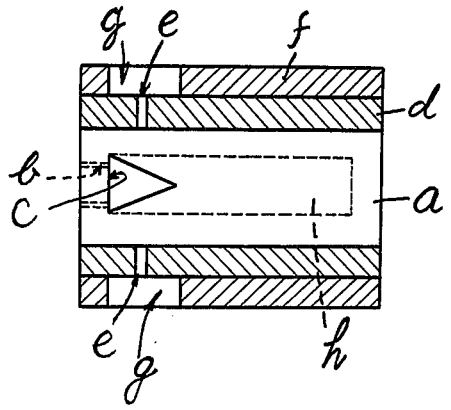
FIG. 1 is a sectional view of a conventional fuel injection device which the present invention is intended to improve.
Figure 3:
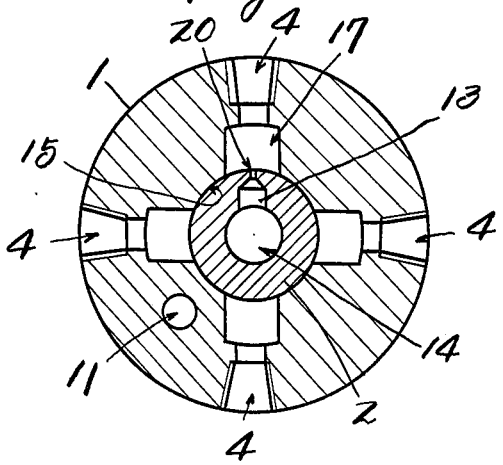
FIG. 3 is a section taken along the line III—III of FIG. 2.
Figure 4:
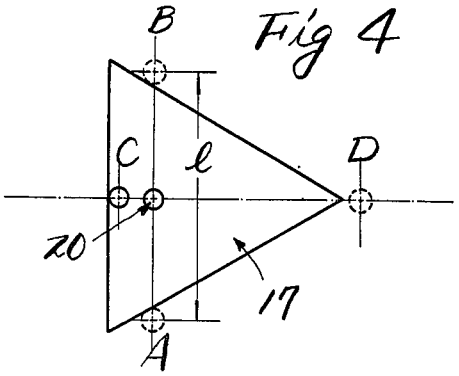
FIG. 4 is an enlarged plan view of the opening surface of a metering port shown in FIG. 4.

The fuel supply port 4 of the main body 1 communicates with an annular cavity 16 formed in the inner surface of a rotor receiving hole 15 in the main body. Thus, the inlet ports 12 of the rotor 2 are in permanent communication with the fuel supply port 3 of the main body 1 through said annular cavity 16. The portions of the fuel distributing ports 4 of the main body 1 which open to the inner surface of the rotor receiving hole 15 are metering ports 17, each of which, as shown in FIG. 4, defines a substantially triangular cavity with one of its three sides extending circumferentially. The number of said metering ports 17 and of fuel distributing ports 4 is the same as the number of cylinders of the engine. Thus, in the case of a 4-cylinder engine, there are four which are circumferentially equispaced, as shown in FIG. 3. Designated at 18 is a drain port which opens to the communication hole 11 and which leads to the fuel tank 5 through a drain pipe 19. The outlet port 13 of the rotor 2 is provided with an orifice 20, which is located at a position such that upon rotation of the rotor 2 it communicates successively with said four metering ports 17. Designated at 21 is a plug member defining the cavity 14, and 22 is a shaft member for driving the rotor 2 supported in bearings 23. Designated at 24 and 25 are members or portions of such members which are fixed to the rotor 2 and shaft member 22, respectively, and which serve to transmit the torque from the shaft member 22 to the rotor 2 and form an axially slidable shaft coupling. Designated at 26 and 27 are a spring member and a bar member, respectively, which are movable right and left in operative association with the output section of the area flowmeter B controlling the flow of air being sucked into the engine. The rotor 2 is urged against the front end of the bar member 27 by the spring 26, so that its axial position will change with the movement of the bar member 27. The pump 6 for feeding fuel under pressure may be driven by a motor through a battery or by the engine.

The above-described fuel injection device which is a typical embodiment of the present invention is mounted on an engine by a suitable attachment (not shown) and the shaft member 22 should be rotated at precisely the speed of the crank shaft by using a suitable power transmission mechanism such as toothed belts and gear wheels (not shown). Fuel is pumped up by the pump 6 from the fuel tank 5 and fed into the fuel supply port 3 through the pressure regulating valve 8. Since the pressure of the pressure regulating valve 8 is controlled by the air pressure in the suction pipe 7, the difference between the pressure in the suction pipe 7, i.e., the pressure in the outlet port of the fuel injector 9 and the pressure in the fuel supply port 3 is maintained constant. The fuel fed into the fuel supply port 3 is then fed from the annular cavity 17 into the cavity 14 via the fuel inlet 12 of the rotor 2. When the rotor 2 is rotated, the orifice 20 which opens to the fuel outlet port 13 of the rotor 2 is circumferentially moved along the metering ports 17 consisting of triangular cavities formed in the rotor receiving hole 15. Thus, in FIG. 4 showing the shape of the metering ports 17, the orifice 20 is moved in the direction A→B. At point A, the orifice 20 begins to open to the metering port 17 and it closes at point B. Since the valve opening pressure of the fuel injector 9, i.e., the difference between the fuel pressure in the metering port 17 and the fuel pressure in the fuel supply port 3, i.e., in the cavity 14 is maintained constant, the fuel flows out of the cavity 14 into the metering port 17 via the orifice 20 at a constant flow speed during the time the orifice 20 opens to the metering port 17. Since the area of the orifice 20 is constant, the fuel flows out into the metering port 17 in an amount which is proportional to its opening time, said fuel then flowing through the fuel pipe 10 into the injector 9, from which it is injected into the manifold of the engine. This injection is performed in synchronism with the suction cycle of the engine. The opening time of the orifice 20 is proportional to the distance l in FIG. 4 and inversely proportional to the peripheral speed of the orifice, i.e., the engine r.p.m. If the rotor 2 is axially moved by the bar member 27, its position changes in the range C–D, and the length l changes correspondingly.

Figures 8A, 8B, 9A, 9B, 10:
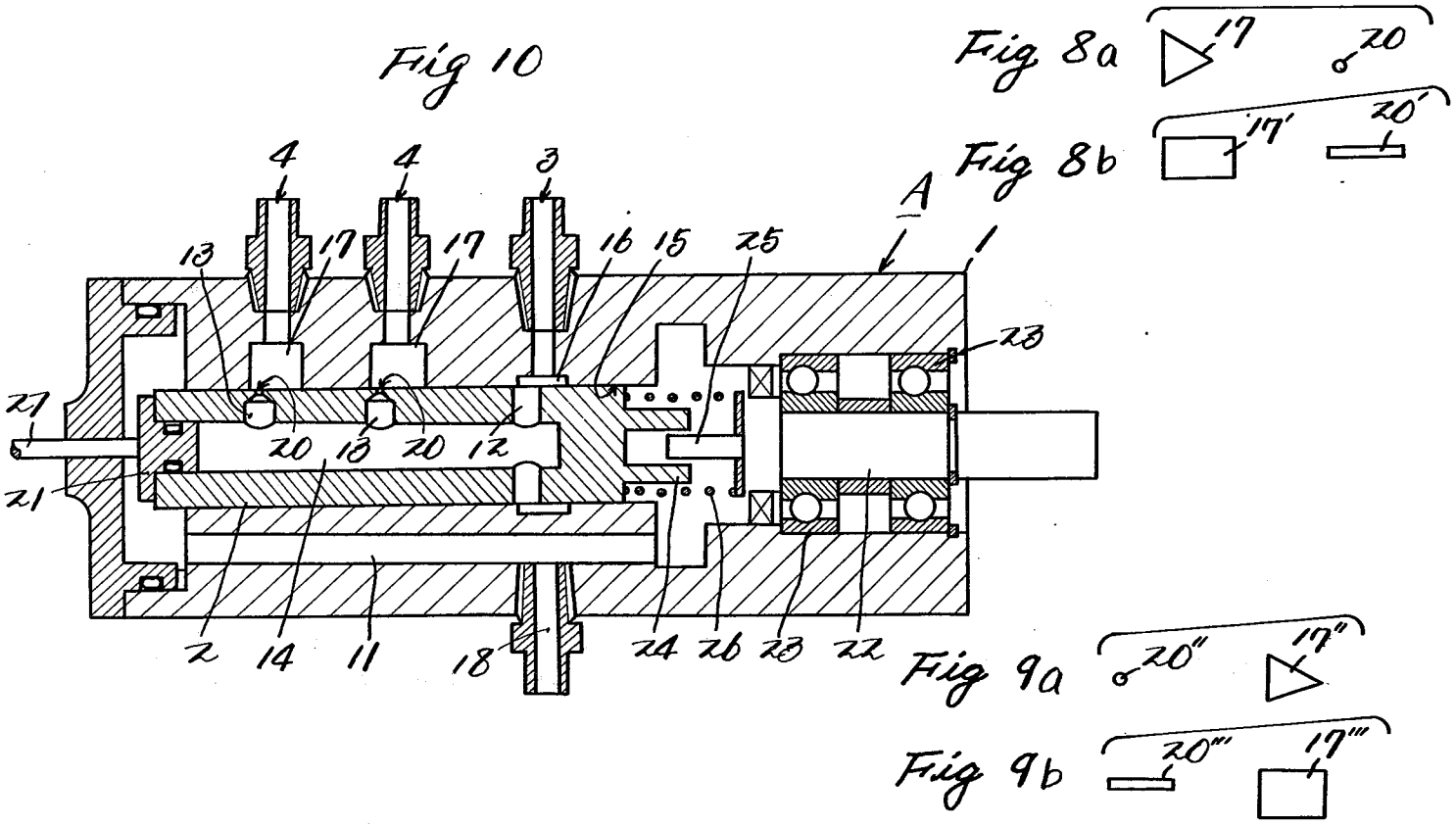
FIGS. 8*a–b* shows by way of example some combinations of a metering port in a main body and a metering port in a rotor, applicable to the invention.
FIGS. 9*a–b* shows by way of example other combinations of such metering ports.
FIG. 10 is a longitudinal section of an embodiment of the invention applied to a torch-ignition type engine.

In addition, said set of metering ports used in embodying the principle of controlling the amount of fuel to be injected are not limited to a combination of an orifice 20 and a metering port 17 consisting of a triangular cavity, shown in FIG. 8*a*. For example, as shown in FIG. 8*b*, instead of said orifice 20, the rotor 2 may be provided with an axially extending narrow slit 20' while the triangular metering port 17 may be replaced by a square or rectangular cavity 17' with two of the four sides extending circumferentially. Thus, the axial displacement of the rotor 2 changes the opening length of the slit 20' relative to the rectangular cavity 17', thereby achieving the control of the amount of fuel to be injected in a manner similar to that described above. Alternatively, as shown in FIGS. 9*a–b*, the main body may be provided with an orifice 20'' or slit 20''' while the rotor may be provided with a triangular or rectangular metering port 17'' or 17'''. In this case, however, it is necessary that a recess or recesses having an aperture area equal to (supply pressure of fuel)×(area of bore)÷(injection pressure) be provided each located diametrically opposite to such port 17'' or 17''' for balance purposes.

The amount of air used per combustion in the cylinder of an engine is proportional to (amount of suction air per unit time)/(r.p.m.). If, therefor, the bar member 27 is moved in proportion to the amount of flow of air in such a manner that it is moved toward C when the amount of air is increased and toward D when it is decreased, as viewed in FIG. 4, then the amount of fuel to be injected at a time can be changed in proportion to the amount of air to be used at a time. Therefore, the mixing ratio of air sucked into the cylinder and fuel can be kept constant. Further, the amount of air to be sucked into the cylinder is controlled by an air throttle valve 28. The axial positions of the rotor 2 used under the actual running conditions of automobile engines are indicated by a shaded area in FIG. 5, in which the horizontal axis is graduated such that the marks 0 and 1 correspond to the positions C and D of FIG. 4, respectively.

The opening surfaces of the metering ports 17 should be the same in shape and size if the amounts of fuel to be fed to all cylinders are the same. If, however, the amount of fuel to be fed must be varied from cylinder to cylinder, their shapes and sizes should be varied accordingly. For example in the case of a 4-cylinder engine, if it is a so-called rich-lean engine in which a rich mixed gas is fed to two cylinders and a lean mixed gas to the other two in such a manner that the rich and lean mixed gases are alternately fed to them, satisfactory results will be obtained if developed views of the inner surfaces of the metering ports 17 of the main body 2 in FIG. 2 are like those shown in FIG. 6. Further, it is also possible to correct the shape of the metering ports 17 according to the output characteristics of the air flowmeter. The shapes shown in FIGS. 9*a–b* are such examples.

The embodiments described so far refer to an application of the fuel injection device of the present invention to 4-cycle 4-cylinder engines, but it may also be applied to 4-cycle engines having 1–3 cylinders by providing 1–3 fuel distributing ports 4 in conformity with the number of cylinders. Further, the invention may be applied to 4-cycle engines having 6 cylinders, 8 cylinders and so on, in which case, as shown in FIG. 10, fuel distributing valves 4 are arranged in two rows each including 3, totaling 6 valves, while the rotor 2 is provided with orifices 20 which are 180° out of phase with each other and which are disposed at positions associated with the two rows of fuel distributing ports 17.

The longitudinal position control of the rotor 2 will now be described.

The longitudinal position control of the rotor 2 is performed by the area flowmeter B shown on the right-hand side of FIG. 2. The area flowmeter B is installed in a main body 30 forming part of an engine suction channel, with the bar member 27 axially slidably supported coaxially with the rotor 2 and permanently urged toward the rotor side by a spring 31. On the other hand, the rotor 2 is urged against the right-hand end of the bar member 27.

An air flow detection valve 32 in the form of a disc is fixed to the bar member 27, while an annular body 33 having a substantially tapered inner surface is integral with said main body 30 or separately formed and fitted therein so as to cooperate with said air flow detection valve 32 to define an annular clearance 34 which functions as a variable orifice. The main body 30 has an air inlet port 35 and an air outlet port 36, said air outlet port 36 being provided with an air flow control valve 28 operatively connected to an accelerator pedal. An intermediate chamber 37 is defined between the flow control valve 28 and air flow detection valve 32, and a cavity 38 is defined on the upstream side of the air flow detection valve 32. The air flow control valve 32 is controlled to assure that the difference between the pressure $P_0$ in the cavity 38 and the pressure $P_1$ in the intermediate chamber 37 is kept constant. That is, the opening area of the annular clearance 34 is caused to change. To this end, a controller 39 is provided at the left-hand end of the control bar 27. The controller 39 has a diaphragm 40 connected to the left-hand end of the control bar 27, defining a left-hand side chamber 40 which communicates with said intermediate chamber 37 through a pipe and a servo-valve 41 for controlling the pressure in said left-hand side chamber, and a right-hand side chamber which opens to the atmosphere. In a transient condition, the pressure $P_1$ in the intermediate chamber 37 changes with the degree of opening of the flow control valve 28 in such a manner that when the degree of opening is increased, the pressure in the intermediate chamber 37 is decreased, so that the pressure in the left-hand side chamber communicating with the intermediate chamber 37 through the servo-valve 41 is decreased, thus causing the leftward movement of the diaphragm 40. As a result, the air flow detection valve 32 is moved to the left to increase the opening area of the annular clearance 34, and simultaneously therewith the rotor 2 of the fuel metering and distributing mechanism A is also moved to the left, thereby increasing the amount of fuel to be injected. Since the communication hole 11 provided in the main body 1 balances the pressures on opposite sides of the rotor, the above-mentioned leftward concomitant movement of the rotor is effected very smoothly. The control bar 27 is provided with a friction damper 42 integral with the bearing for more or less controlling the movement of the control bar 27. The friction damper 42 is in the form of a sleeve made of a material having a suitable degree of softness and wear resistance, e.g., nylon, and it is formed with a plurality of axial slots extending from its intermediate region to one end and has a spring 43 entrained therearound for providing a radially contracting force, whereby a suitable degree of friction is imparted to the control bar 27.

The operation of the area flowmeter B will now be described with reference to FIG. 2.

The air which has flowed into the air inlet port 35 of the main body 30 of the area flowmeter B through an air filter (not shown) passes successively through the cavity 38, the annular clearance 34 around the air flow detection valve 32, and the intermediate chamber 37 and by the flow control valve 28 and is sucked into the suction manifold 7 of the engine. The volume flow of air per unit time flowing through the annular clearance 34 is proportional to the root of the pressure difference $P_\alpha$ between the cavity 38 and the intermediate chamber 37 and to the opening area of the annular clearance 34. In FIG. 2, when the amount of flow of air being sucked into the engine is set by the flow control valve 28 operatively connected to the accelerator pedal, the pressure difference $P_\alpha$ between the cavity 38 and the intermediate chamber 37 is kept constant by adjusting the opening area of the annular clearance 34. Therefore, the amount of flow of air can be known by the opening area of the annular clearance 34. In the construction shown in FIG. 2, since the opening area of the annular clearance 34 is uniquely associated with the axial position of the air flow detection valve 32, the axial position of the rotor 2 is uniquely associated with the amount of flow of air. Since the axial position of the rotor determines the amount of fuel to be injected per unit time by the fuel metering and distributing mechanism A, it follows that a fixed relation is established between the amount of air to be fed and the amount of fuel to be fed.

In recent low-pollution engines, it is necessary that the air-fuel weight ratio be kept constant.

The generating lines of the tapered inner surface of the annular body 33, in this case, may be substantially straight lines, but it is also possible to correct the shape so as to match with the characteristics of the fuel metering and distributing mechanism A.

The operation for controlling the axial position of the air flow detection valve 32 in order to keep the above-mentioned pressure difference $P_\alpha$ constant is performed by the controller 39. In the case of FIG. 2 using a servo-mechanism powered by the negative pressure in the intermediate chamber 37, the output from the servo-valve 41 detecting and amplifying a deviation of $P_\alpha$ from the set valve controls the pressure on the diaphragm 40 of the controller 39.

The pressure difference $P_\alpha$ produces a thrust which tends to move the air flow detection valve 32 to the left. The sum of this thrust, the force of the spring 26 and the force on the diaphragm 40 is balanced by the force exerted by the deflection of the spring 31. As $P_\alpha$ deviates from the set value, the thrust due to the pressure difference $P_\alpha$ acting on the air flow detection valve 32 also changes. The amount of change in this force assists the controller 39 in correcting the position of the air flow detection valve 32 in such a direction as to bring $P_\alpha$ back to the set value.

Therefore, the ability of the air flow detection valve 32 to follow up the flow control valve 28 as the latter is suddenly operated is improved. On the other hand, however, too high sensitivity would cause hunting. The friction damper 42 is effective to prevent this phenomenon. This is because the dry friction of the damper 42 prevents the correction movement (the axial movement of the valve) from taking place when $P_\alpha$ changes slightly but that it permits such correction movement only when the fluid pressure acting on the diaphragm 40 changes in response to the operation of the servo-mechanism.

The embodiment shown in FIG. 2 is a combination of the area flowmeter B and fuel metering and distributing mechanism B, which are simple in construction and operate accurately, thus providing an inexpensive and accurate fuel injection device.

Particularly in the embodiment shown in FIG. 2, the air flow detection valve 32 of the area flowmeter B is in the form of an easy-to-produce disc and is installed coaxially with the rotor 2 of the fuel metering and distributing mechanism A, so that the movement of the air flow detection valve can be transmitted directly to the rotor 2, thus assuring reliable operation with minimized response lag. Further, since the generating lines of the tapered inner surface of the annular body 33 forming the channel of the air flowmeter can be easily corrected in accordance with the characteristics of the fuel metering section, matching between them can be easily obtained. Further, since an unbalanced force which is exerted by a deviation from the set value of the pressure difference $P_\alpha$ acting on the disc-shaped air flow detection valve 32 acts in such a direction as to correct the deviation, the response to sudden changes in the amount of flow is satisfactory. Further, since a friction damper utilizing dry friction is provided to act on the shaft 27 of the valve 32, hunting is prevented.

As for the construction of the area flowmeter B described so far, various types may be contemplated, including rotary valve type and flap type. Therefore, in the present invention intended to accurately control the air-fuel ratio for engines by using a combination of a fuel metering and distributing mechanism including a rotor having an orifice or slit, and an area flowmeter, various modifications are possible.

FIG. 10 shows a fuel injection device of the invention applied to a torch-ignition type engine. Two discharge ports are provided in phase with each other, and it is also possible to feed gases of different air-fuel ratios to the auxiliary chamber and the main combustion chamber at the same time.

As has been described so far, the invention provides a simple and inexpensive device capable of performing injection control and fuel distribution on the basis of r.p.m. by using the same mechanism. Further, since injection is effected in synchronism with the suction stroke of the engine, atomization of fuel is satisfactory. Since the rotor is supported on an oil film formed of fuel oil, wear is minimized and service life is long. Thus, a fuel injection device which is simple in construction and operates accurately can be provided. Particularly, since the fuel metering and distributing mechanism and the area flowmeter for suction air are integrated, the attachment of the device to an engine is easy. Further, a minor change of design allows the device to be applied to various types of engines including multi-cylinder engines and torch-ignition type engines.

Figure 11:
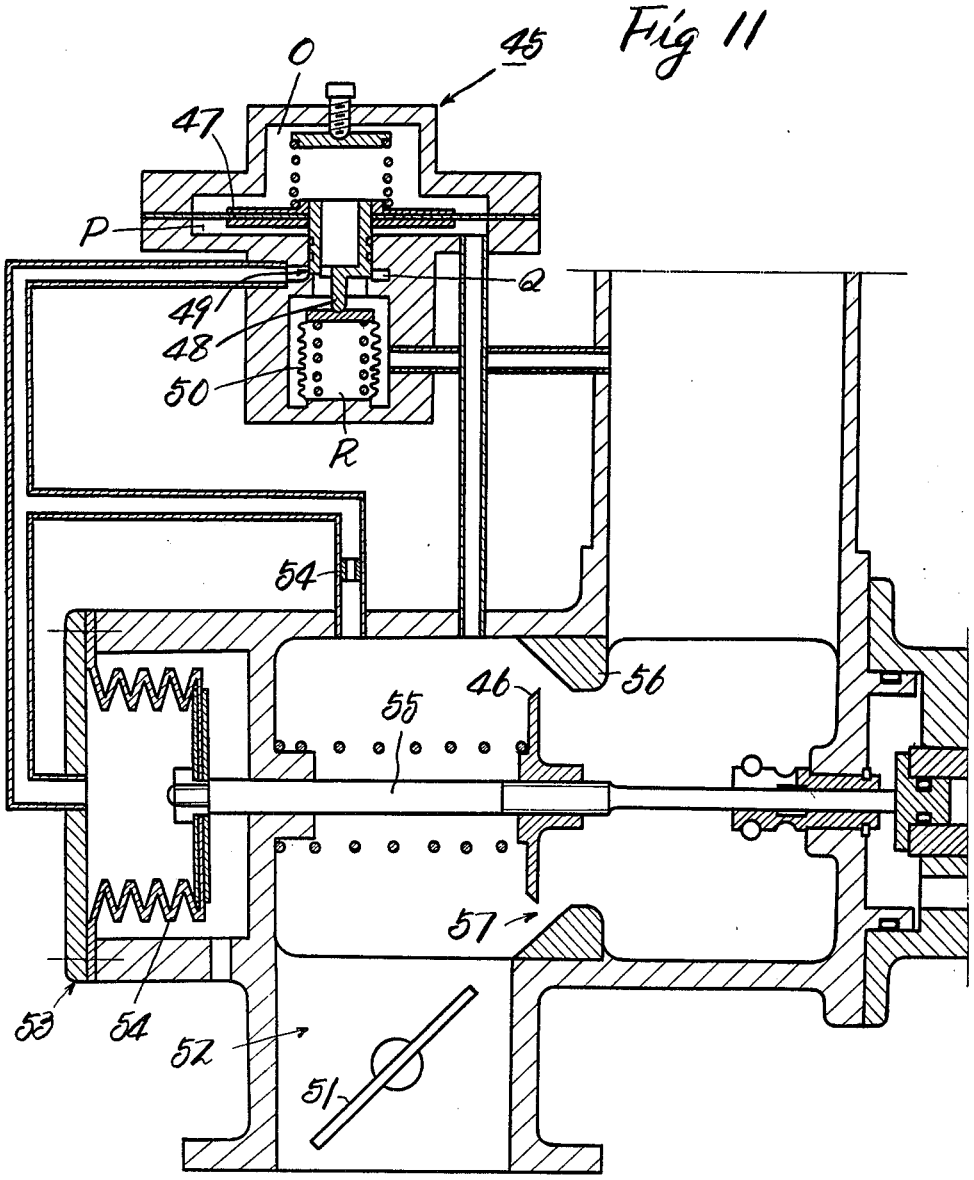
FIG. 11 is a longitudinal section showing a more concrete form of the device of FIG. 2 according to the invention.

FIG. 11 illustrates an embodiment of a servo-valve for use with a controller for controlling the opening and closing of an air flow detection valve in an area flowmeter.

A servo-valve 45 comprises a pressure difference setting diaphragm 47 for detecting a deviation from a set value of the difference in the pressures existing on both sides of an air flow detection valve 46 disposed in a channel, chambers O and P separated from each other by the pressure difference setting diaphragm 47, a control valve 48 operatively connected to the pressure difference setting diaphragm 47, a chamber Q communicating with said chamber O through a variable orifice 49 defined between the control valve 48 and its valve seat, and a chamber R housing a bellows 50 which encloses a gas having the same pressure and temperature as normal atmospheric pressure and temperature for correcting the set pressure value of the pressure difference setting diaphragm 47 by means of changes in the density of incoming air and which has an effective area expressed by the formula (effective area of pressure difference setting diaphragm)×(reference pressure difference)÷(pressure of enclosed gas).

The chambers O and R are acted upon by a pressure $P_1$ which exists upstream of the air flow detection valve 46, while the chamber P is acted upon by a pressure $P_2$ in an intermediate chamber 52 which is defined between the air flow detection valve 46 and a flow control valve 51. The chamber Q communicates with the left-hand side chamber of a controller 53 and with the intermediate chamber 52 through a fixed choke 54. The bellows 50 communicates with the pressure difference setting diaphragm 47.

The servo-valve 45 operates in the following manner.

When the accelerator pedal is stepped on to open the flow control valve, namely, throttle valve 51, the pressure $P_2$ in the intermediate chamber is decreased and the pressure in the chamber P is decreased. Therefore, the balanced condition of the pressure difference setting diaphragm 47 is upset and the diaphragm is displaced to decrease the opening area of the variable orifice 49. As a result, the pressure $P_n$ in the chamber Q, which is variable between $P_1$ and $P_2$, is decreased. The pressure $P_n$ in the chamber Q acts on the left-hand side chamber of the controller 53, and the pressure $P_n$ in the bellows 54 of the controller 53 is thus decreased, causing the leftward movement of a control rod 55 fixed to the bellows 54. The movement of the control rod 55 causes the movement of the air flow detection valve 46 fixed thereto, thereby opening an annular clearance 57 defined by cooperation between said valve 46 and a substantially tapered annular body 56. As a result, $P_2$ is gradually increased and the air flow detection valve 46 is opened until $(P_1-P_2)$ equals the set value. In cases where the throttle valve 51 is closed to increase $P_2$, an operation of opposite effect takes place. If the pressure and/or temperature of the incoming air varies, the bellows 50 slightly expands or contracts to vary the initial set value of the pressure difference setting diaphragm 47 to correct the amount of suction air with respect to variations in the density of air.

Figure 12:
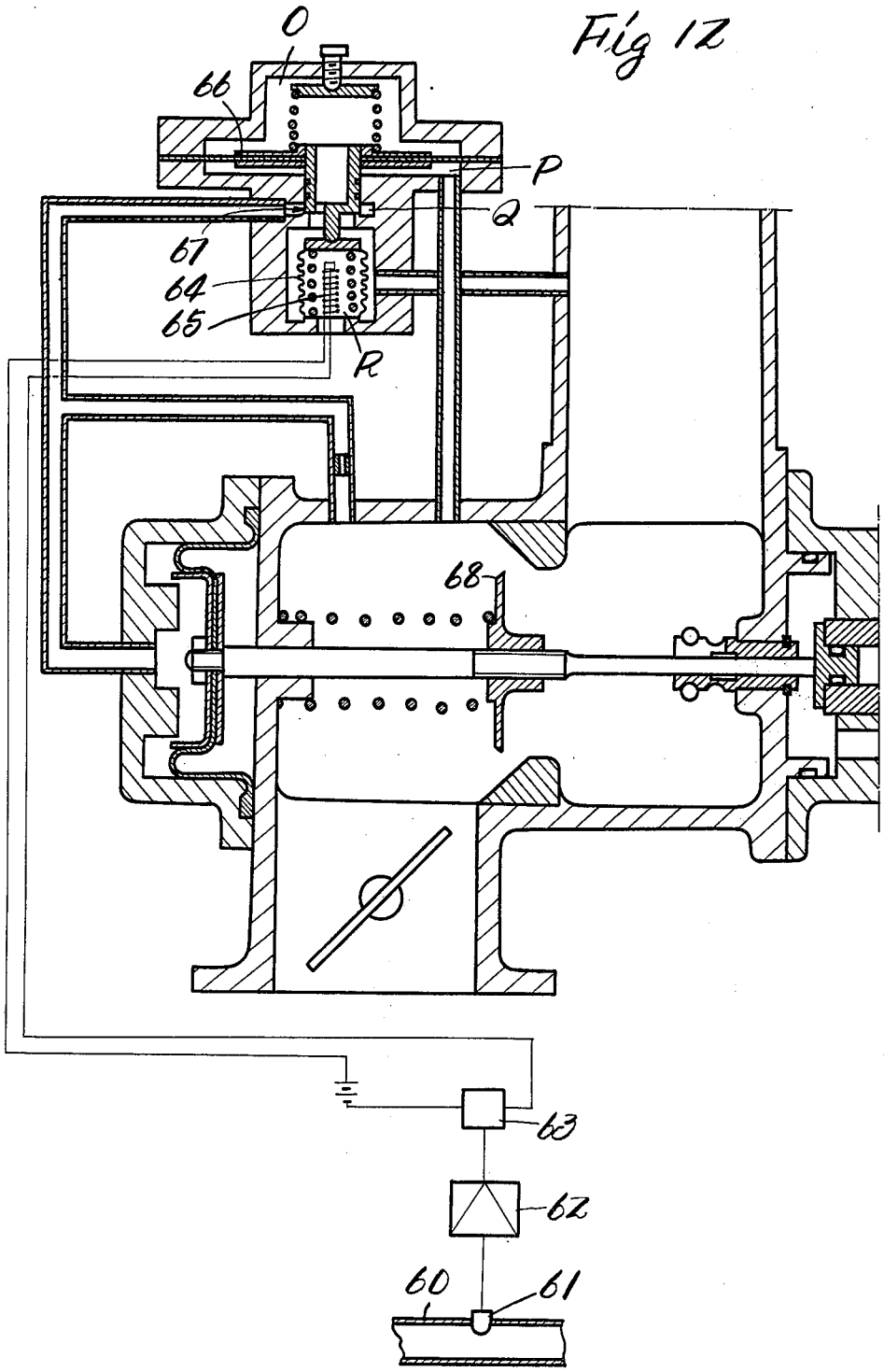
FIG. 12 is a longitudinal section of a modification.

FIG. 12 shows a feedback control device for controlling the set value of the pressure difference setting diaphragm of the servo-valve so as to provide the optimum air-fuel ratio. In this case, the pressure difference setting diaphragm is set to a value which is on the richer side than on the basis of the theoretical air-fuel ratio.

This feedback control device comprises a senser 61 placed in an exhaust pipe 60 for detecting variations in the exhaust gas composition, an amplifier 62 for amplifying the output from said senser 61, a limit switch 63 controlled by said amplifier, and a heater 65 installed in the bellows 64 of the servo-valve. As for the senser 61, in the case of controlling the air-fuel ratio so as to maintain the theoretical air-fuel ratio, it is suitable to use an oxygen concentration senser utilizing the electromotive force of zirconium dioxide ($ZrO_2$). Zirconium dioxide exhibits a votage variation resembling a step function in the vicinity of the theoretical air-fuel ratio. When the air-fuel ratio is below the theoretical one, i.e., on the rich side, the oxygen concentration of exhaust gas is low with the result of the senser 61 giving an output. This output is amplified by the amplifier 62, actuating the switch 63 to energize the heater 65, whereupon the gas in the bellows is expanded to slightly extend the bellows 64, pushing up the diaphragm 66. This means that the pressure difference value initially set has been corrected. As a result, the opening area of the variable orifice 67 is increased to increase the pressure $P_n$ in the chamber Q, causing the air flow detection valve 68 to move to the right until it is balanced, thus, moving the rotor 69 of the fuel metering and distributing mechanism A to the right to decrease the amount of fuel to be injected, with the result that the air-fuel ratio is corrected so as to be on the lean side. If the air-fuel ratio is shifted to the lean side, the senser 61 ceases to give its output and the heater 65 is deenergized, with the result that the air-fuel ratio is corrected so as to be on the rich side. In this way, this feedback control device controls the air-fuel ratio by the output from the senser 61 so as to bring it in the vicinity of the theoretical air-fuel ratio. In addition, though not shown, the bellows 68 may be replaced by a bimetal disposed adjacent the heater so as to push up the pressure difference diaphragm upon energization of the heater.

In FIGS. 11 and 12, the fuel metering and distributing mechanism A and the area flowmeter B are the same in construction as those described in FIG. 2, so that a detailed description thereof is omitted.

Whiles there have been described herein what are at present considered preferred embodiments of the several features of the invention, it will be obvious to those skilled in the art that modifications and changes may be made without departing from the essence of the invention.

It is therefore to be understood that the exemplary embodiments thereof are illustrative and not restrictive of the invention, the scope of which is defined in the appended claims and that all modifications that come within the meaning and range of equivalency of the claims are intended to be included therein.

We claim:

1. A fuel injection device for use with an internal combustion engine having an air suction inlet comprising a main body having a longitudinally extending cylindrical bore, a fuel supply port and a plurality of fuel metering ports communicating with said bore; each of said metering ports having a configuration in the form of a substantially triangular window opening with one of its three sides extending circumferentially; a plurality of fuel distributing ports communicating with said fuel metering ports; a cylindrical rotor disposed in said cylindrical bore of said main body; said rotor having an inlet port communicating with said fuel supply port of said main body and a metering port communicating with said inlet port and associated with said metering port of said main body; drive means for rotating said rotor in synchronism with the rotation of the internal combustion engine; control means for longitudinally sliding said rotor in accordance with the amount of air supplied by the air suction inlet of the internal combustion engine; and fuel supply means for supplying the fuel supply portion of the main body with pressurized fuel whereby the lengths of time for communication between the individual metering ports of the main body and the metering port of the rotor are controlled in connection with the r.p.m. of the engine and the amount of air supplied through the air suction inlet.

2. A fuel injection device as set forth in claim 1, wherein the metering ports are cylindrical ports, while the rotor has a metering port in the form of a substantially triangular window opening with one of its three sides extending circumferentially, and a recess having an opening area expressed by the formula (supply pressure of fuel)×(area of window opening)/(injection pressure), said recess serving to balance the radial force acting on the rotor.

3. A fuel injection device as set forth in claim 1, wherein each of the metering ports of the main body is in the form of a substantially rectangular window opening with two of its four sides extending circumferentially, while the metering port of the rotor is a slit.

4. A fuel injection device as set forth in claim 1, wherein the metering ports of the main body are slits, while the rotor has a metering port in the form of a substantially rectangular window opening with two of its four sides extending circumferentially, and a recess having an opening area expressed by the formula (fuel supply pressure)×(area of window opening)/(injection pressure), said recess serving to balance the radial force acting on the rotor.

5. A fuel injection device as set forth in claims 3, wherein the recess is located 180° opposite the window opening.

6. A fuel injection device as set forth in claim 1, wherein the main body is provided with at least one longitudinally extending communication hole at a place where it is not always immersed in fuel, said hole serving to establish communication between both sides of the rotor disposed in the cylindrical bore of the main body.

7. A fuel injection device for use with an internal combustion engine having an air suction inlet comprising a main body having a longitudinally extending cylindrical bore, a fuel supply port and a plurality of fuel metering ports communicating with said bore, each of said metering ports having a configuration in the form of a substantially triangular window opening with one of its three sides extending circumferentially, and a plurality of fuel distributing ports communicating with said metering ports; a cylindrical rotor disposed in said cylindrical bore of said main body and having an inlet port communicating with said fuel supply port of the main body and a metering port communicating with said inlet port and with the fuel metering ports of the main body; drive means for rotating the rotor in synchronism with the rotation of the internal combustion engine; a flow detection valve, a flow metering mechanism operatively associated with the air suction inlet and fixed to one side of the main body for opening and closing said flow detection valve so as to keep constant the difference in the pressures existing on both sides of said flow detection valve; and fuel supply means for supplying the fuel supply port of the main body with fuel through a pressure regulator, whereby the lengths of time for communication between the individual metering ports of the main body and the metering port of the rotor are controlled in connection with the r.p.m. of the engine and with the degree of opening of the flow detection valve.

8. A fuel injection device as set forth in claim 7, wherein the flow metering mechanism is formed on part of the air suction inlet.

9. A fuel injection device as set forth in claim 7, wherein the flow detection valve is of the disc type and cooperates with a substantially conical annular body to define an annular clearance.

10. A fuel injection device as set forth in claim 9, wherein the degree of opening of the disc type flow detection valve is associated with the longitudinal position of the rotor through a control rod fixed to said valve and disposed in series with said control rod.

11. A fuel injection device as set forth in claim 10, wherein a friction member is provided between the control rod and the main body.

12. A fuel injection device for use with an internal combustion engine having an air suction inlet comprising a main body having a longitudinally extending bore, a fuel supply port and a plurality of fuel metering ports communicating with said bore, each of said metering portions having a configuration in the form of a substantially triangular window opening with one of its three sides extending circumferentially, and a plurality of fuel distributing ports communicating with said metering ports; a cylindrical rotor disposed in the cylindrical bore of the main body and having a metering port communicating with the metering ports of the main body; drive means for rotating said rotor in synchronism with the rotation of the internal combustion engine; a flow detection valve, a combustion flow metering mechanism operatively associated with the air suction inlet and fixed on one side of the main body for controlling the opening and closing of said flow detection valve so as to keep constant the difference in the pressures existing on both sides of said flow detection valve; a servo-control mechanism for controlling the opening and closing of the flow detection valve of said flow metering mechanism said servo-control mechanism consisting of a pressure-sensitive amplifier unit for causing a pressure difference setting diaphragm to sense variations in the pressures on both sides of the flow detection valve relative to the set pressure, and a controller for controlling the opening and closing of the flow detection valve by means of the output from the pressure-sensitive amplifier mechanism; and fuel supply means for supplying the fuel supply port of the main body with fuel through a pressure regulator, whereby the lengths of time for communication between the individual metering ports of the main body and the metering port of the rotor are controlled in connection with the r.p.m. of the engine and with the degree of opening of the flow detection valve.

13. A fuel injection device as set forth in claim 12, including a correction mechanism for correcting the set value of the pressure-sensitive amplifier mechanism of the servo-control mechanism.

14. A fuel injection device as set forth in claim 13, wherein the correction mechanism consists of a bellows interlocked to the pressure difference setting diaphragm, said bellows containing a gas having the same pressure and temperature as normal atmospheric pressure and temperature, said bellows having an effective area expressed by the formula (effective area of pressure difference setting diaphragm)×(reference pressure difference)÷(enclosed gas pressure).

15. A fuel injection device as set forth in claim 10, wherein the pressure-sensitive amplifier mechanism is designed so that the pressure difference setting diaphragm is set to a value to provide a fuel-rich mixed gas, while the correction mechanism consists of an exhaust gas senser placed in an exhaust pipe, a switch adapted to be opened and closed by the output from said exhaust gas senser, a heater adapted to be actuated by said switch, and a heat-sensitive member adapted to be displaced by said heater, the arrangement being such that the set value of the pressure difference setting diaphragm is corrected in such a manner as to provide a fuel-lean mixed gas when the heater is energized.

16. A fuel injection device as set forth in claim 15, wherein the exhaust gas senser is an oxygen senser utilizing the electromotive force of zirconium dioxide.

17. A fuel injection device as set forth in claim 15, wherein the heat-sensitive member is a bellows having a gas enclosed therein.

18. A fuel injection device as set forth in claim 15, wherein the heat-sensitive member is a bimetal.

* * * * *